US005337725A

United States Patent [19]

Narita

[11] Patent Number: 5,337,725

[45] Date of Patent: Aug. 16, 1994

[54] SELF-DIAGNOSTIC APPARATUS FOR EXHAUST GAS RECIRCULATING APPARATUS

[75] Inventor: Masaki Narita, Shizuoka, Japan

[73] Assignee: Suzuki Motor Corporation, Shizuoka, Japan

[21] Appl. No.: 124,341

[22] Filed: Sep. 20, 1993

[30] Foreign Application Priority Data

Jan. 30, 1993 [JP] Japan ..... 5-034595

[51] Int. Cl.[5] ..... F02M 25/07

[52] U.S. Cl. ..... 123/571

[58] Field of Search ..... 123/568, 569, 571

[56] References Cited

U.S. PATENT DOCUMENTS

| | | | |
|---|---|---|---|
| 4,770,146 | 9/1988 | Shibata et al. | 123/571 X |
| 4,825,841 | 5/1989 | Norota et al. | 123/571 X |
| 5,137,004 | 8/1992 | Takahata et al. | 123/571 |
| 5,152,273 | 10/1992 | Ohuchi | 123/571 |
| 5,154,156 | 10/1992 | Ohuchi | 123/571 |
| 5,184,594 | 2/1993 | Saitoh et al. | 123/571 |
| 5,251,599 | 10/1993 | Ohuchi et al. | 123/571 X |
| 5,257,610 | 11/1993 | Ohuchi | 123/571 |

FOREIGN PATENT DOCUMENTS

| | | |
|---|---|---|
| 2-75748 | 3/1990 | Japan . |
| 4-140464 | 5/1992 | Japan . |

*Primary Examiner*—Willis R. Wolfe

*Attorney, Agent, or Firm*—Flynn, Thiel, Boutell & Tanis

[57] ABSTRACT

A self-diagnostic apparatus for determining whether an exhaust gas recirculating apparatus is in an abnormal condition. The exhaust gas recirculating apparatus includes a second negative pressure path for directly connecting an intake path to an EGR valve for bypassing a modulator, a second switching valve located in line with the second negative pressure path, and a control unit for controlling the second switching valve which fully opens and closes the EGR valve when a vehicle is decelerating. Pressure variations within the intake path are caused by the opening and closing action of the EGR valve. The pressure variations are detected by the intake path pressure sensor in order to determine a deteriorating condition of the exhaust gas recirculating apparatus in accordance with the detected pressure variation values.

6 Claims, 4 Drawing Sheets $\Delta Pb = |Pb3 - Pb2|$ $\Delta Pb <$ SET VALUE → DETERIORATED

SELF-DIAGNOSTIC APPARATUS FOR EXHAUST GAS RECIRCULATING APPARATUS

FIELD OF THE INVENTION

This invention relates to a self-diagnostic apparatus for an exhaust gas recirculating apparatus, and more particularly to an exhaust gas recirculating apparatus which comprises a second negative pressure path for communicating an intake path to an EGR valve for bypassing a modulator, and in which a variation of intake pipe pressure caused by fully opening and closing the EGR value utilizing the second negative pressure path is detected so that a deteriorating condition of the exhaust gas recirculating apparatus can be determined in accordance with the detected pressure value.

BACKGROUND OF THE INVENTION

A conventional exhaust gas recirculating apparatus comprises a circulating path for returning or circulating exhaust gas, after combustion, in a discharge path to an intake path, and an EGR (exhaust gas return) value located in line with the circulating path. The EGR valve is controllably opened and closed depending upon an operating condition of engine in order to purify the exhaust gas.

As one example of such apparatus, Japanese Patent Early Laid-Open Publication No. Hei 2-75748 discloses a self-diagnostic apparatus for an exhaust gas recirculating apparatus. The self-diagnostic apparatus comprises a fuel supply stop determining means for determining whether or not the supply of fuel to an engine is currently stopped, an exhaust gas recirculation forced start means for forcedly opening an exhaust gas recirculation control valve when it is determined that the supply of fuel is currently stopped, an intake tube pressure detection means for detecting intake pipe pressure, and a determining means for introducing the intake pipe pressure detected by the intake pipe pressure detection means separately at two time points, i.e., when the exhaust gas recirculation control valve is forcedly opened by the exhaust gas recirculation forced start means and when not opened, and for determining that the exhaust gas recirculating apparatus is in failure, when a difference between the intake pipe pressure introduced at the two different time points is equal to or less than a predetermined value. In this conventional apparatus, the failure diagnosis is positively made.

Japanese Patent Early Laid-Open Publication No. Hei 4-140464 discloses another example. The self-diagnostic apparatus for exhaust gas recirculating apparatus disclosed in this publication comprises an exhaust return control valve located in an exhaust return path and opened and closed by negative pressure, and a negative pressure control means for controlling the negative pressure which is supplied to the exhaust return control valve. The apparatus also includes an intake pressure sensor for detecting a downstream pressure of an intake system relative to a throttle valve, means for forcedly fully closing and opening the exhaust return control valve, means for detecting a variation of the intake pressure caused by the fully closing or opening action of the exhaust return control valve in accordance with the intake pressure sensor, and means for determining whether or not the exhaust return apparatus is in failure in accordance with the variation of intake pressure. In a modified form, the self-diagnostic apparatus for exhaust gas recirculating apparatus includes an exhaust return control valve located in an exhaust return path which is opened and closed by negative pressure, and a diaphragm-type negative pressure control valve for diluting the negative pressure coming from a throttle valve which is nearly in a fully closed position by the atmosphere in order to make it generally constant with the exhaust pressure upstream relative to the exhaust return control valve and then supplying the same to the exhaust return control valve. The apparatus further includes a first pressure detection means for detecting a negative pressure which is supplied to the exhaust return control valve, a second pressure detection means for the exhaust pressure, and means for determining whether or not the exhaust return apparatus is in failure in accordance with the detection value detected by the first pressure detection means or the second pressure detection means. A determination whether or not the exhaust is returned at a proper return rate in order to prevent NOx from being discharged is also performed.

As shown in FIG. 4, a conventional self-diagnostic apparatus for an exhaust gas recirculating apparatus comprises a throttle valve 108 located in line with an intake path 104 of an engine 102, a circulating path 110 for communicating a downstream side of intake path 104 (relative to the throttle valve 108) to an exhaust path 106, whereby an exhaust gas circulates from the exhaust path 106 to the intake path 104 by way of the circulating path 110. An EGR valve 112 is located in line with the circulating path 110. The EGR valve 112 communicates with an exhaust-type modulator 114. This modulator 114 includes a negative pressure path 116 which communicates with the intake path 104 near the throttle valve 108. A first three-way switching valve (VSV) 118 is located in line with the negative pressure path 116. An intake pipe pressure sensor 124 communicates, through a pressure path 122, with the intake path 104 near an intake side opening 120 of the circulating path 110. Sensor 124 and switching valve 118 are both coupled to an electronic control unit (ECU) 130.

To determine whether or not there is a failure in the exhaust gas recirculating apparatus, such as a clogging of the circulating path, the circulation of the exhaust gas is turned off by deactivating the EGR valve 112 for a predetermined time (for example, a few seconds) during a generally constant vehicle speed. The intake pipe absolute pressure is detected at the time when the exhaust gas is being introduced and also at the time when the exhaust gas is not being introduced, so that the determination can be made in accordance with a difference in pressure.

With this prior system, as shown in FIG. 5, an intake pipe absolute pressure Pb1 is detected at the time when the exhaust gas is introduced (i.e., when the EGR valve 112 is turned on). An intake pipe absolute pressure Pb2 is detected at the time when the EGR valve 112 is turned off. An intake pipe absolute pressure Pb3 is detected at the time when the EGR valve 112 is turned on again. The pressure difference is calculated in accordance with the expression $\Delta Pb = |Pb3 - Pb2|$. The exhaust gas recirculating apparatus is determined to be in an abnormal condition (i.e., in failure) when this pressure difference $\Delta Pb$ is less than a predetermined value.

However, the flow of exhaust gas within the circulating path is only a little more than ten percent of the exhaust gas flowing within the exhaust path. Therefore, the pressure difference between the intake pipe pressure at the time when the exhaust gas is being introduced and the intake pipe pressure at the time when the exhaust gas is not being introduced is minimal. As a result, the diagnostic accuracy and reliability are low and thus disadvantageous in view of practical use. Additionally, when an output condition of the engine is taken into consideration, an introduction time and non-introduction time are obtained during a positive torque area (generally constant vehicle speed) and thereafter the intake pipe absolute pressure is detected. Therefore, the function of the exhaust gas recirculating apparatus which purifies the exhaust gas, and the performance of the vehicle are adversely affected during execution of the conventional self-diagnostic apparatus. Improvement is desired.

According to the present invention, there is provided, in order to obviate the above-mentioned inconveniences, an exhaust gas recirculating apparatus having a throttle valve located in an intake path for an engine, a circulating path for communicating a downstream side of said intake path relative to the throttle valve to a discharge path, an EGR valve located in the circulating path, an exhaust pressure-type modulator communicating with the EGR valve, a first negative pressure path communicating the modulator to the intake path near the throttle valve, a first three-way switching valve located in the first negative pressure path, and an intake pipe pressure sensor communicating with the intake path through a pressure path. A self-diagnostic apparatus for the exhaust gas recirculating apparatus is also provided. The self-diagnostic apparatus includes a second negative pressure path for directly interconnecting the intake path and the EGR valve so as to bypass the modulator, a second three-way switching valve is located in the second negative pressure path, and a control unit is provided for controlling the second three-way switching valve which fully opens and closes the EGR valve when the vehicle is decelerating. Variations of the intake pipe pressure caused by the opening and closing action of the EGR valve are detected by the intake pipe pressure sensor in order to determine a deteriorating condition of the exhaust gas recirculating apparatus in accordance with the variations of intake pipe pressure.

The control unit activates and deactivates the second three-way switching valve to fully open and close the EGR valve when decelerating. The variation of the intake pipe pressure caused by the opening and closing action of the EGR valve is detected by the intake pipe pressure sensor in order to determine a deteriorating condition of the exhaust gas recirculating apparatus in accordance with the variation of the intake pipe pressure. Accordingly, the accuracy and reliability are improved by utilizing the large variations of pressure, rather than the minimal pressure differences of the prior art.

The present invention will now be described hereinafter with reference to the drawings.

DETAILED DESCRIPTION OF THE INVENTION

Figure 1:
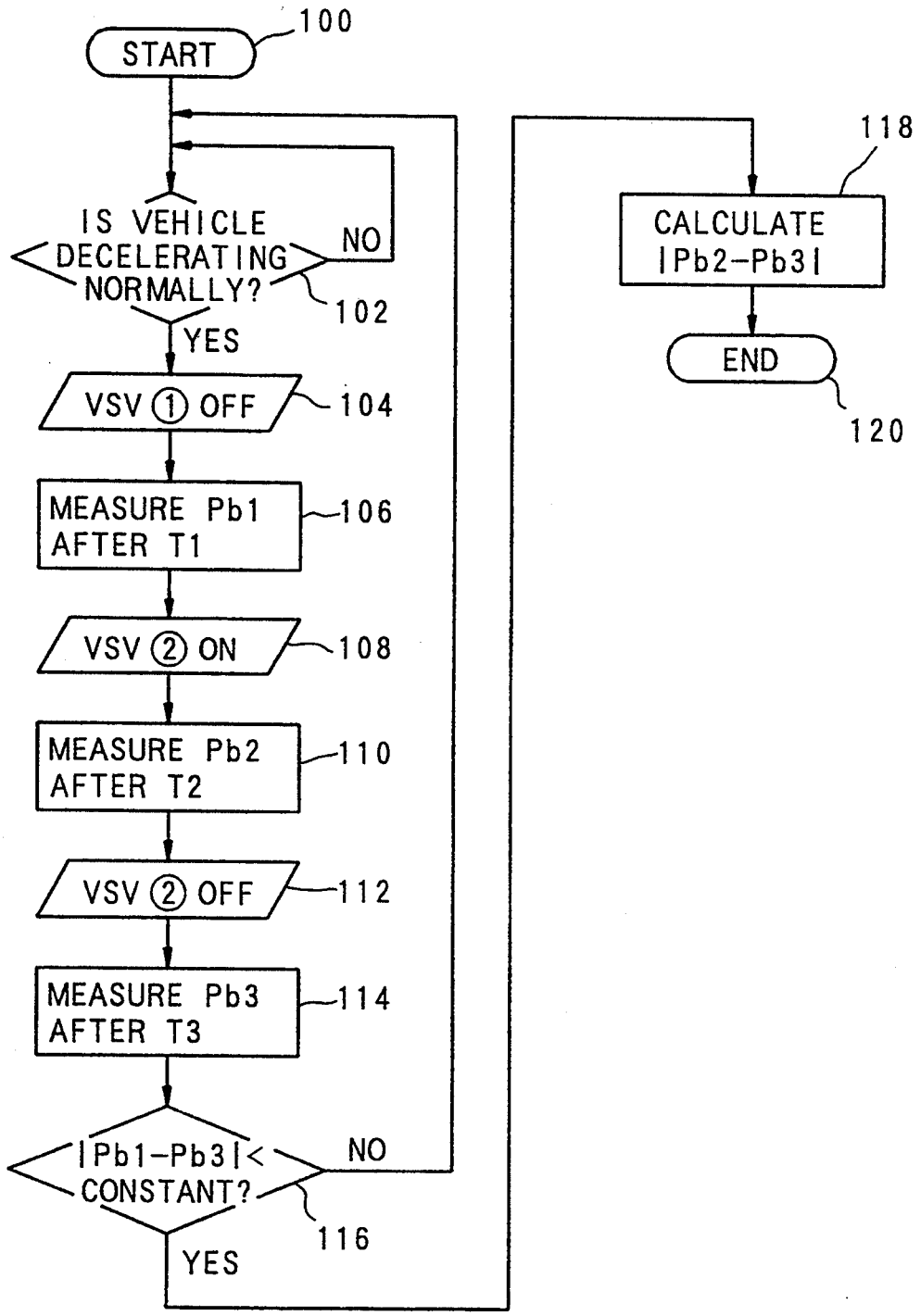
FIG. 1 illustrates a flow chart for controlling the self-diagnosis according to one embodiment of the present invention.
Figure 2:
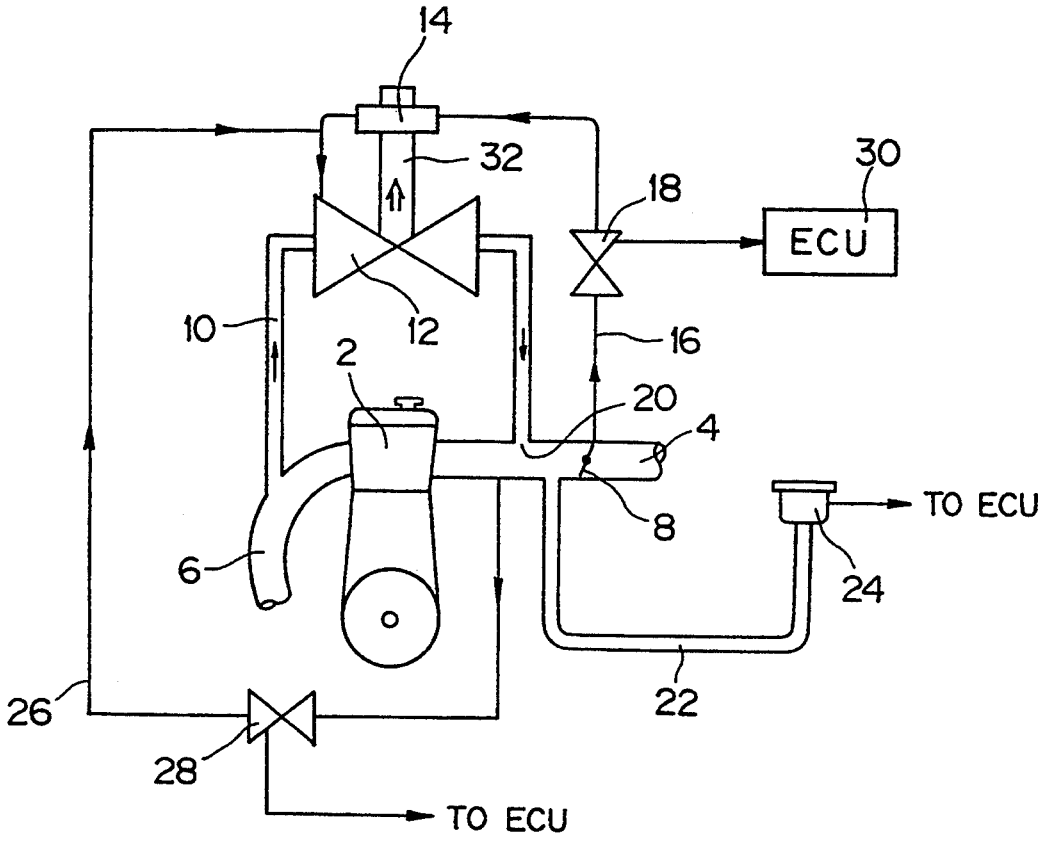
FIG. 2 is a schematic view of a self-diagnostic apparatus for an exhaust gas recirculating apparatus.
Figures 3A, 3B, 3C, 3D, 3E:
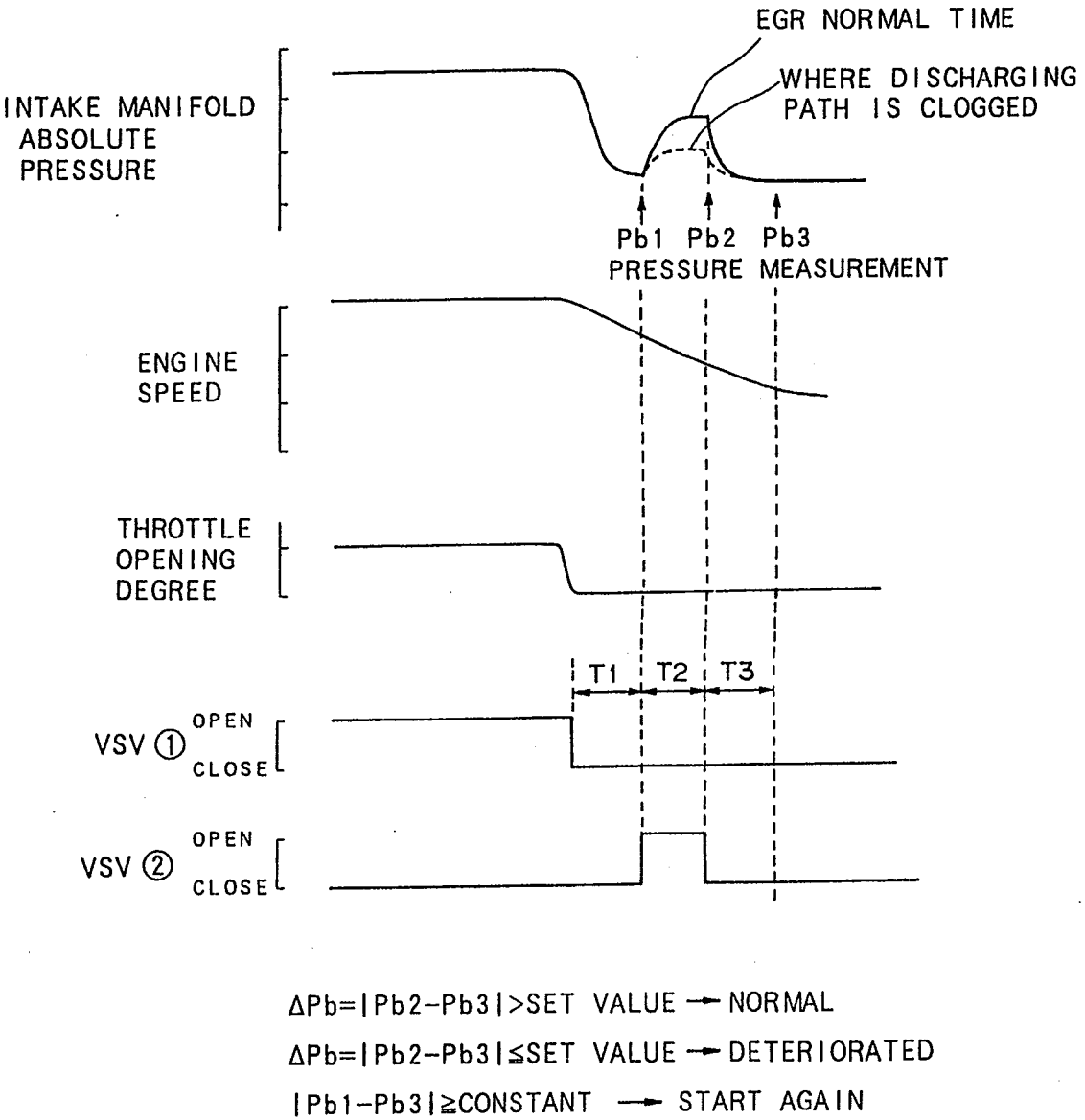
FIGS. 3*a*–3*e* illustrate a time chart for controlling the self-diagnosis when the vehicle is decelerating.
Figure 4:
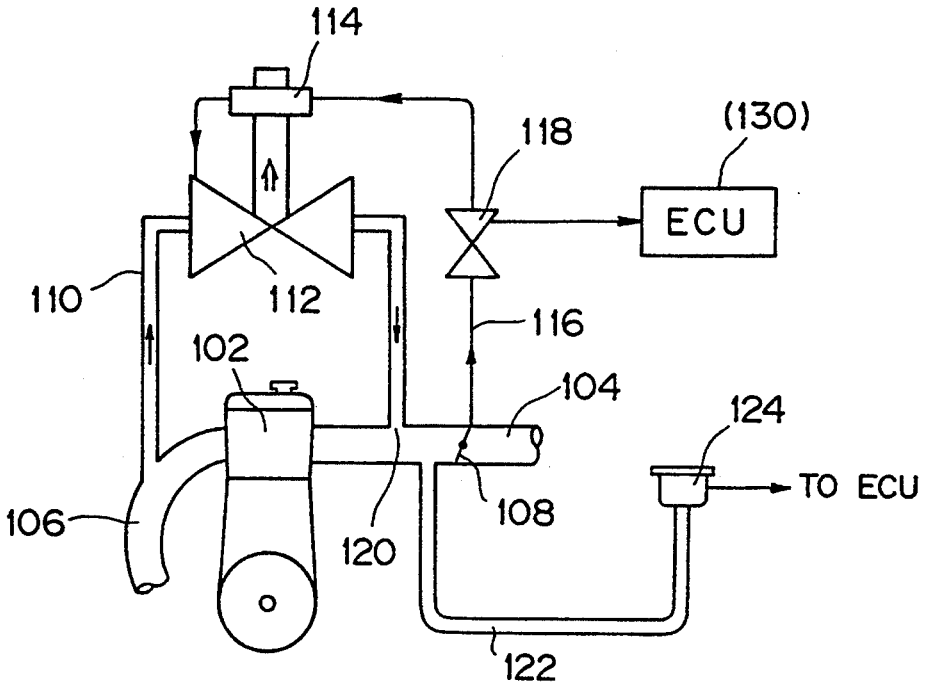
F I G. 4 PRIOR ART
FIG. 4 is a schematic view of a self-diagnostic apparatus for an exhaust gas recirculating apparatus according to the prior art.
Figure 5:
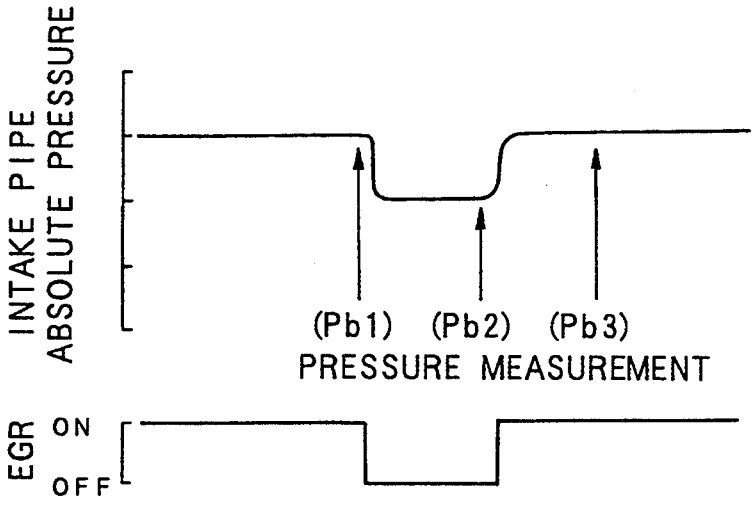
F I G. 5 PRIOR ART
FIG. 5 illustrates a time chart for controlling the self-diagnosis according to the prior art.

FIGS. 1 to 3*e* illustrate a preferred embodiment of the present invention. In FIG. 2, 2 denotes an engine, 4 an intake path, and 6 a discharging path. A throttle valve 8 is located in line with the intake path 4. A circulating path 10 communicates a downstream side of the intake path 4 relative to the throttle valve 8 to the discharging path 6. An EGR valve 12 is located in line with of the circulating path 10. A discharge pressure type modulator 14 communicates with the EGR valve 12. The modulator 14 includes a first negative pressure path 16 which communicates with the intake path 4 near the throttle valve 8. A first three-way switching valve 18 (i.e. VSV1) is disposed in line with the first negative pressure path 16. An exhaust pressure hose 32 communicates the EGR valve 12 to the exhaust pressure-type modulator 14.

An intake pipe pressure sensor 24 communicates through a pressure path 22, with the intake path 4 upstream from circulating path 10 relative to its intake side opening 20 which is downstream from throttle valve 8.

A second negative pressure path 26 communicates at one end with the intake path 4 downstream from circulating path 10 relative to its intake side opening 20, and communicates with a diaphragm chamber (not shown) of the EGR valve 12 at the other end. A second three-way switching valve 28 (i.e. VSV2) is located in line with the second negative pressure path 26. The first three-way switching valve 18 and the second three-way switching value 28 are atmosphere opening-type three-way switching valves. The first and second three-way switching valves 18 and 28 as well as the intake pipe pressure sensor 24 are connected to a control unit 30.

The control unit 30 activates and deactivates the second three-way switching valve 28 to fully open and close the EGR valve 12 only when the vehicle is decelerating. A variation of the intake pipe pressure caused by the opening and closing action of the EGR valve 12 is detected by the intake pipe pressure sensor 24 in order to determine the condition of the exhaust gas recirculating apparatus in accordance with the variation of the intake pipe pressure.

More specifically, the control unit 30 initially determines whether the vehicle is decelerating with reference to various conditions such as vehicle speed, throttle opening degree, engine speed, and the like. Once the control unit 30 determines that the vehicle is decelerating, the first three-way switching valve 18 is turned off which in turn, fully closes EGR valve 12. The intake pipe pressure Pb1 is detected by the intake pipe pressure sensor 24 after a first predetermined amount of time T1 elapses from the time the first three-way switching valve 18 was turned off. The intake pipe pressure valve Pb1 is stored in the control unit 30. The second three-way switching valve 28 is then turned on which fully opens the EGR valve 12 by negative pressure. The intake pipe pressure Pb2 is then detected and stored after a second predetermined time period T2 elapses from the fully opening action of the EGR valve 12. After the intake pipe pressure Pb2 is detected, the second three-way switching valve 28 is turned off to fully close the EGR valve 12. An intake pipe pressure Pb3 is then detected and stored after a third predetermined time period T3 elapses from the fully closing action of the EGR valve 12. Intake pipe pressure values Pb2 and Pb3 are likewise stored in the control unit 30.

The control unit 30 calculates a pressure difference value ΔPb in accordance with the stored intake pipe pressures Pb1, Pb2 and Pb3. Thereafter, various determinations are made in accordance with the pressure difference value. That is, when the following expression is satisfied, $$|Pb1-Pb3| \geqq \text{constant},$$

the control unit 30 determines that the vehicle is not decelerating normally and thereafter terminates the diagnosis. In contrast, when the expression, $$|Pb1-Pb3| < \text{constant},$$

is satisfied, the control unit 30 determines that the vehicle is decelerating normally and proceeds with the diagnosis. When the pressure difference value satisfies the following expression, $$\Delta Pb = |Pb2-Pb3| > \text{set value}$$

the control unit 30 determines that the exhaust gas recirculating apparatus is normal. In contrast, when the pressure difference value satisfies the following expression, $$\Delta Pb = |Pb2-Pb3| > \text{set value}$$

the control unit 30 determines that the exhaust gas recirculating apparatus is abnormal, i.e., deteriorated.

The operation of the self-diagnostic apparatus of FIG. 2 will be described with reference to the flow chart of FIG. 1 and the time chart of FIGS. *3a–3e*.

When the engine 2 is started, a program for controlling the self-diagnosis apparatus is started at step 100. In step 102, it is determined whether or not the vehicle is decelerating with reference to various conditions such as vehicle speed, throttle opening degree, engine speed, and the like. If the result of step 102 is "NO", the procedure is repeated until the result of step 102 becomes "YES". When the result of step 102 is "YES", control advances to step 104 where the first three-way switching valve (VSV1) 18 is turned Off by the control unit 30 so that the EGR valve 12 is fully closed.

control then passes to step 106 wherein the intake pipe pressure Pb1, as an intake manifold absolute pressure is measured (detected) and stored in the control unit 30 after a first predetermined time period T1 (such as one second) elapses from the closing of first three-way switching valve (VSV1) 18.

Control then passes to step 108 wherein the second three-way switching valve (VSV2) 28 is turned on by the control unit 30 so that the EGR valve 12 is fully opened. In step 110 the intake pipe pressure Pb2, as an intake manifold absolute pressure is measured (detected) and stored in the control unit 30 after a second predetermined time period T2 (such as two seconds) elapses from the opening of the second three-way switching valve (VSV2) 28.

control then passes to step 112 where the second three-way switching valve (VSV2) 28 is turned off by the control unit 30 to fully close the EGR valve 12. Thereafter, in step 114, the intake pipe pressure Pb3, as an intake manifold absolute pressure is measured (detected) and stored in the control unit 30 after a third predetermined time period T3 (such as two seconds, this time T3 normally being the same as the time T2) elapses from the closing of the second three-way switching valve (VSV2) 28.

After the three intake pipe pressure valves Pb1, Pb2, and Pb3 are detected and stored in the control unit 30, the pressure difference between the intake pipe pressure Pb1 and Pb2 is compared with the predetermined constant according to the following expression:

$$|Pb1-Pb3| < \text{constant}.$$

It is determined whether or not the above expression is satisfied in step 116.

If the result of step 116 is "NO", in other words, if the pressure difference value is equal to or greater than the constant, the control unit 30 determines that it is not a normal deceleration and thereafter cancels the self-diagnostic test. The program then returns to step 102 to initiate the self-diagnostic routine again. If the result of step 116 is "YES", in other words, if the pressure difference is less than the constant, the control unit 30 determines that the vehicle is normally decelerating. The program then proceeds to step 118 where a calculation of $|Pb2-Pb3|$ is made.

In step 118, the pressure difference value is calculated in accordance with the following expression:

$$\Delta Pb = |Pb2-Pb3| > \text{set value}.$$

It is determined that the exhaust gas recirculating apparatus is normal if this expression is satisfied. In contrast, when the pressure difference value satisfies the following expression:

$$\Delta Pb = |Pb2-Pb3| \leqq \text{set value},$$

it is determined that the exhaust gas recirculating apparatus is abnormal, in other words, the apparatus is deteriorated.

Owing to the foregoing arrangement for determining whether or not the exhaust gas recirculating apparatus is in an abnormal condition, the pressure values obtained when the EGR value 12 is fully opened and fully closed are larger than the conventional pressure difference values, thus improving the accuracy and reliability of the self-diagnosis determination of the present invention.

Since the determination as to whether or not the exhaust gas recirculating apparatus is in an abnormal condition is primarily made when the vehicle is decelerating i.e., the fuel is cut-off to the engine, there is no possibility that the function for purifying the exhaust gas and the performance of the vehicle are adversely affected. Moreover, the detected data (pressure values) are stable compared with the conventional determination which is made at the time when the vehicle is running at a constant speed.

Furthermore, by virtue of the present arrangement, the construction is not complicated, manufacture is easy, and the cost can be maintained at a low level.

As described in the foregoing, according to the present invention, there is provided an exhaust gas recirculating apparatus comprising a throttle valve located in line with an intake path for an engine, a circulating path for communicating a downstream side of the intake path relative to the throttle valve to a discharge path, an EGR valve located in line with the circulating path, an exhaust pressure type modulator communicating with the EGR valve, a first negative pressure path communicating with the modulator and communicating with the intake path near the throttle valve, a first three-way switching valve located in line with the first negative pressure path, and an intake pipe pressure sensor communicating with the intake path through a pressure path. Exhaust gas, after combustion, is circulated in the discharge path from the exhaust path to the intake path, wherein a self-diagnostic apparatus for the exhaust gas recirculating apparatus is executed. The self-diagnostic apparatus includes a second negative pressure path for directly communicating the intake path to the EGR valve by bypassing the modulator, a second switching valve located in line with the second negative pressure path, and a control unit for controlling the second three-way switching valve which fully opens and closes the EGR valve when a vehicle is decelerating. Variations of the intake pipe pressure caused by the opening and closing action of the EGR valve are detected by the intake pipe pressure sensor in order to determine a deteriorating condition of the exhaust gas recirculating apparatus in accordance with the variations of intake pipe of pressure. Accordingly, for determining whether or not the exhaust gas recirculating apparatus is in an abnormal condition, pressure difference values are obtained at the time when the EGR value 12 is fully opened and when fully closed, which are larger than conventional pressure difference values thus improving the accuracy and reliability of the self-diagnostic determination. Moreover, since the determination as to whether or not the exhaust gas recirculating apparatus is in an abnormal condition is made when the vehicle is decelerating, there is no possibility that the function for purifying the exhaust gas and the performance of the vehicle are adversely affected. In addition, the detected data is stable compared with a conventional determination which is made at the time when the vehicle is running at a constant speed.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an exhaust gas recirculating apparatus for a vehicle, including a throttle value located in line with an intake path for an engine; a circulating path for communicating the intake path downstream from the throttle value to a discharge path whereby exhaust gas in the discharge path is circulated to the intake path; an EGR value disposed in line with the circulating path; an exhaust pressure-type modulator communicating with the EGR value; a first negative pressure path communicating the modulator to the intake path near the throttle value; a first three-way switching valve disposed in line with the first negative pressure path for closing the EGR value; an intake path pressure sensor communicating with the intake path through a pressure path; and a self-diagnostic apparatus, the improvement wherein the self-diagnostic apparatus comprises:

a second negative pressure path for directly connecting the intake path to the EGR value for bypassing the modulator, a second switching valve disposed in line with said second negative pressure path, and a control means for controlling said second three-way switching valve to fully open and close the EGR value only when the vehicle is decelerating so that variations of an intake pipe pressure caused by the opening and closing action of the EGR valve are detected by the intake pipe pressure sensor in order to determine a deteriorating condition of the exhaust gas recirculating apparatus in accordance with said detected variations of intake pipe pressure.

2. A self-diagnostic apparatus for an exhaust gas recirculating system of an internal combustion engine in a vehicle, the exhaust gas circulating system having a recirculating path communicating an engine exhaust path disposed downstream from a combustion chamber to an air intake path disposed upstream from the combustion chamber, an EGR valve disposed in the circulation path, and exhaust pressure-type modulator communicating with the EGR valve, a first negative-pressure path communicating the modulator with the air intake path adjacent a throttle valve disposed in the air intake path, first valve means disposed in the first negative-pressure path for closing the first path when the vehicle is decelerating thereby closing the EGR valve, and a pressure sensor communicating with the air intake path for sensing a pressure in the air intake path, the self-diagnostic apparatus comprising:

a second negative pressure path for communicating the air intake path to the EGR valve for bypassing the modulator;

second valve means disposed in said second negative pressure path for opening and closing the EGR valve in response to a control signal; and control means for determining the condition of said exhaust gas recirculating apparatus, said control means including means for determining whether the vehicle is decelerating, means for generating said control signal only when the vehicle is decelerating in accordance with predetermined operating conditions, means for detecting a variation in the pressure in the air intake path caused by opening and closing the EGR valve, and means for determining whether a deteriorating condition of the exhaust gas recirculating apparatus is present in accordance with said variation in the pressure in the air intake path.

3. The self diagnostic apparatus as claimed in claim 2 wherein said control means further includes means for recording a first pressure value measured by the pressure sensor after a first time period elapses from the closing of the EGR valve by the first valve means; means for recording a second pressure value measured by the pressure sensor after a second time period elapses from the opening of the EGR valve by said second valve means; and means for recording a third pressure value measured by the pressure sensor after a third time period elapses from the closing of the EGR valve by said second valve means.

4. The self diagnostic apparatus as claimed in claim 3, wherein said control means determines that the vehicle is decelerating in accordance with said predetermined operating conditions when an absolute difference value between said first and third pressure values is less than a constant.

5. The self diagnostic apparatus as claimed in claim 3, wherein said control means determines that the exhaust gas recirculating apparatus is deteriorated when an absolute difference value between said second and third pressure values is less than or equal to a set value.

6. An exhaust gas recirculating apparatus for an internal combustion engine of a vehicle, the internal combustion engine having a combustion chamber, an air intake path disposed upstream from the combustion chamber, a throttle valve disposed in line with the air intake path, and a discharge path disposed downstream from the combustion chamber for discharging exhaust gas generated in the combustion chamber, the exhaust gas recirculating apparatus comprising:

a circulating path for communicating the discharge path to the air intake path downstream from the throttle valve;

EGR valve means disposed in line with said circulating path for fully opening and closing said circulating path to redirect a portion of the exhaust gas from the exhaust path to the air intake path;

an exhaust pressure-type modulator communicating with said EGR valve means;

a first negative pressure path for communicating said modulator to the air intake path at a position near the throttle valve;

first valve means disposed in line with said first negative pressure path for closing said first negative pressure path when the vehicle is decelerating thereby closing said EGR valve means;

pressure sensing means communicating with the air intake path for sensing a pressure in the air intake path;

a second negative pressure path communicating the air intake path to said EGR valve for bypassing said modulator;

second valve means disposed in line with said second negative pressure path for opening and closing said EGR valve means in response to a control signal; and a control means for determining the condition of the exhaust gas recirculating apparatus, said control means including means for determining whether the vehicle is decelerating in accordance with predetermined operating conditions, means for generating said control signal only when the vehicle is decelerating in accordance with said conditions, means for detecting a variation in the pressure in the air intake path caused by opening and closing said EGR valve means, and means for determining whether a deteriorating condition of the exhaust gas recirculating apparatus is present in accordance with said variation in the pressure in the air intake path.

* * * * *

UNITED STATES PATENT AND TRADEMARK OFFICE

CERTIFICATE OF CORRECTION

PATENT NO. : 5,337,725

DATED : August 16, 1994

INVENTOR(S) : Masaki Narita

It is certified that error appears in the above-indentified patent and that said Letters Patent is hereby corrected as shown below:

Column 7, line 52; change "value" to ---valve---.
line 55; change "value" to ---valve---.
line 57; change "value" to ---valve---.
line 59; change "value;" to ---valve;---.
line 61; change "value;" to ---valve;---.
line 63; change "value;" to ---valve;---.
line 68; change "value" to ---valve---.

Column 8, line 5; change "value" to ---valve---.

Signed and Sealed this

Twenty-second Day of November, 1994

*Attest:*

Bruce Lehman

BRUCE LEHMAN

*Attesting Officer*

*Commissioner of Patents and Trademarks*